United States Patent [19]
Cutler

[11] 4,425,863
[45] Jan. 17, 1984

[54] PENDULUM HELMSMAN SEAT

[76] Inventor: Terrill D. Cutler, 518 Kendall Ave., Los Angeles, Calif. 90042

[21] Appl. No.: 240,118

[22] Filed: Mar. 3, 1981

[51] Int. Cl.³ ..... B63B 29/12
[52] U.S. Cl. ..... 114/363; 114/194; 297/314; 297/423; 297/439
[58] Field of Search ..... 114/39, 194, 144 R, 114/363; 244/122 R; 9/7; 297/326, 273, 277, 279, 423, 438, 439, 314, 344

[56] References Cited

U.S. PATENT DOCUMENTS

| | | | |
|---|---|---|---|
| 2,919,746 | 1/1960 | Fidel | 297/423 |
| 2,939,512 | 6/1960 | Pohl | 297/314 |
| 3,428,976 | 2/1969 | Robinson | 9/7 |
| 3,851,916 | 12/1974 | Quartullo | 9/7 |
| 4,046,419 | 9/1977 | Schmitt | 297/344 X |
| 4,254,990 | 3/1981 | Kelley | 114/194 |

FOREIGN PATENT DOCUMENTS

| | | | |
|---|---|---|---|
| 217318 | 12/1907 | Fed. Rep. of Germany | 114/194 |

OTHER PUBLICATIONS

Edson Catalog K-7, The Edson Corporation, 460 Industrial Park Road, New Bedford, Mass. 02745, 1972.

*Primary Examiner*—Sherman Basinger
*Attorney, Agent, or Firm*—Harvey B. Jacobson

[57] ABSTRACT

A seat mounting structure is provided defining a base portion for stationary mounting in a boat hull subject to roll movement and including a rudder control member oscillatable about a first fore and aft extending horizontal axis. A mount portion is supported from the base portion for adjustable vertical shifting relative thereto and a seat structure is oscillatably supported from the mount portion in pendulum fashion for swinging about a second fore and aft extending horizontal axis with the first and second axes disposed at least generally in the same vertical plane and the mount portion being vertically adjustable relative to the first axis to enable at least general horizontal alignment of the first and second axes. In addition, an upwardly opening arcuate footrest is provided for mounting between the seat structure and the rudder control member and the footrest is supported for vertical adjustment whereby the feet of a helmsman seated on the seat structure may be comfortably rested upon the footrest. Also, the base portion of the seat mounting structure and the footrest each include structure whereby they may be independently shifted in fore and aft directions relative to the boat hull.

5 Claims, 6 Drawing Figures

PENDULUM HELMSMAN SEAT

BACKGROUND OF THE INVENTION

Various ship hulls are subject to roll movements and some ships include helmsmen seats whereby the helmsmen may be comfortably seated while steering the ship hull. However, the task of steering a ship in heavy seas wherein roll movements are imparted to the ship is difficult and tiring due to the fact that the helmsman experiences gravity and inertia forces tending to bias the helmsman toward opposite sides of the ship as a result of roll movements thereof. Accordingly, a need exists for structure whereby the helmsman of a ship subject to roll movements may be more comfortably seated while performing his helmsman's tasks.

Examples of pendulum-type seats as well as gimble supported seats including some of the general structure and operational features of the instant invention are disclosed in U.S. Pat. Nos. 12,703, 968,195 and 2,740,599. However, these previously known forms of seats are not specifical-adapted for use in conjunction with ships subject to roll movements, or are not inclusive of various adjustments enabling the seat structures to be adjusted to suit a particular helmsman. Also, these previously known forms of pendulum-type or gimble supported seat structures do not include adequate footrests and/or adjustable friction brake structure whereby the oscillation of the seat structure relative to its support may be dampened.

SUMMARY OF THE INVENTION

The helmsman's seat of the instant invention is constructed in a manner to define a helmsman's seat supported in pendulum fashion and also in a manner whereby the axis of swinging of the seat structure may be adjusted vertically so as to be substantially horizontally aligned with the axis of oscillation of the associated steering control. In addition, the helmsman's seat is adjustable to the size of the particular helmsman using the seat and further includes vertically adjustable footrest structure which may be utilized in conjunction with the seat in order to provide maximum comfort for the helmsman. Still further, the helmsman's seat is constructed in a manner whereby the seat and the footrest may each be independently adjusted in a fore and aft direction relative to the associated hull and the associated steering control.

The main object of this invention is to provide a helmsman's seat which will provide maximum comfort and stability to a helmsman of a ship experiencing roll movements.

Another object of this invention is to provide an improved helmsman's seat which may be adjusted in various manners in order to accommodate helmsmen of different sizes and to tailor the comfort afforded thereby to a particular helmsman.

Still another important object of this invention is to provide an improved helmsman's seat which may be readily incorporated into boat hulls of different types.

Yet another object of this invention is to provide an improved helmsman's seat in accordance with the preceding objects and including structure by which the oscillatable and pendulum-type seat structure thereof may be adjustably friction braked.

Another object of this invention is to provide a helmsman's seat of such construction to be readily adaptable for mounting in various different types of boat hulls.

A final object of this invention to be specifically enumerated herein is to provide a helmsman's seat in accordance with the preceding objects and which conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
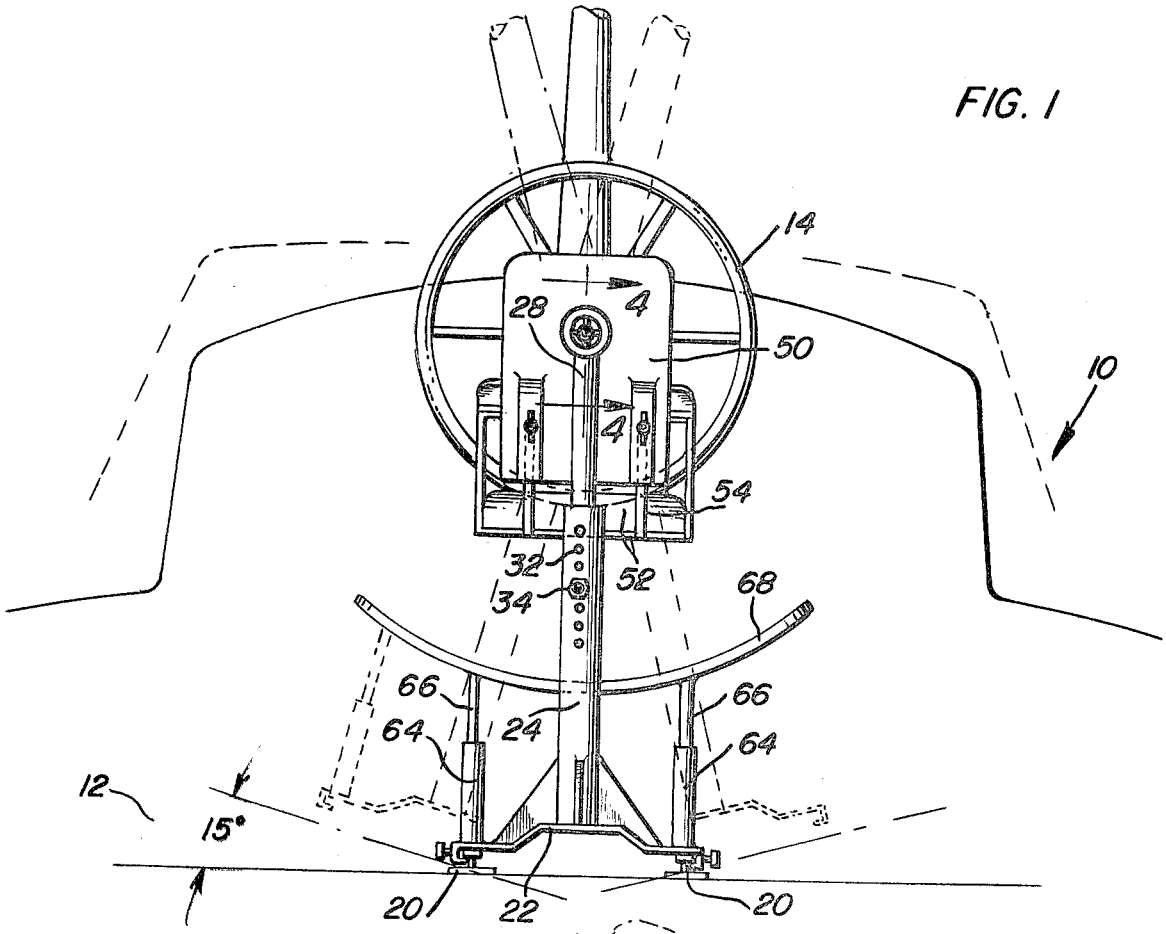
FIG. 1 is a rear elevational view of the helmsman's seat of the instant invention as mounted within the cockpit of a sailboat.
Figure 2:
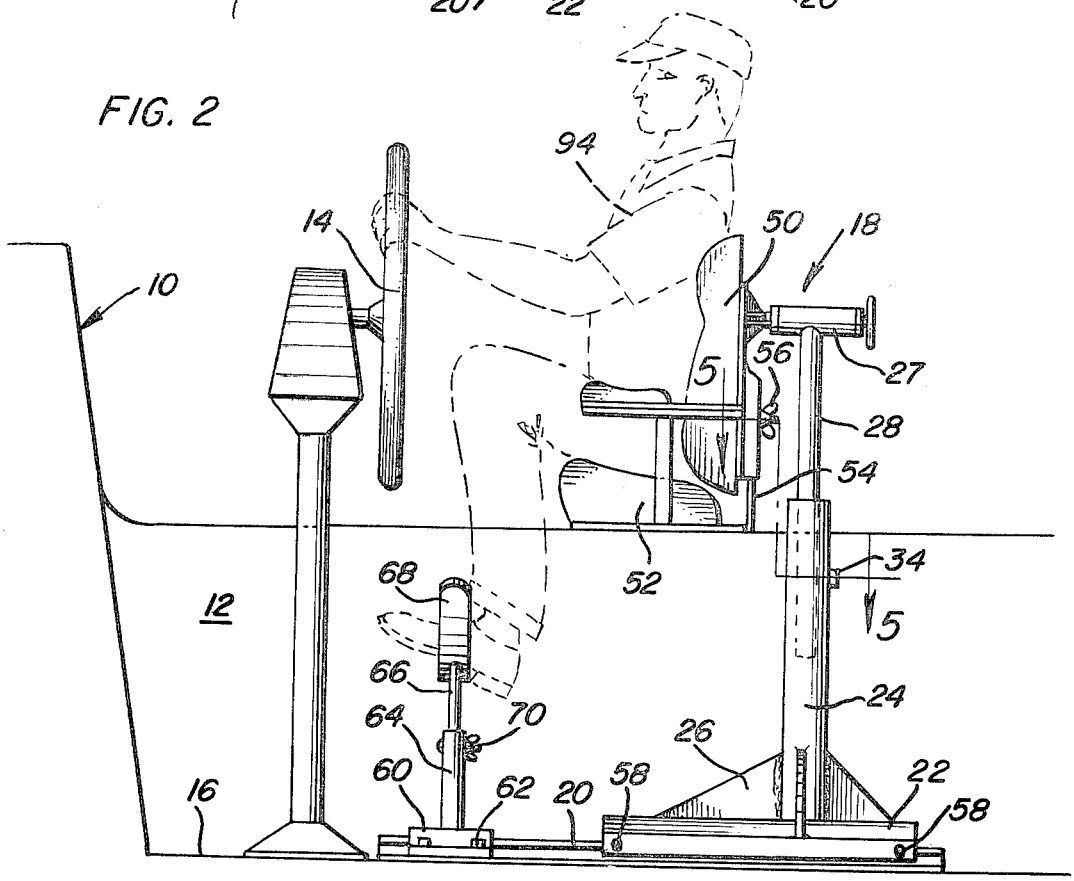
FIG. 2 is a side elevational view of the assemblage illustrated in FIG. 1.
Figure 3:
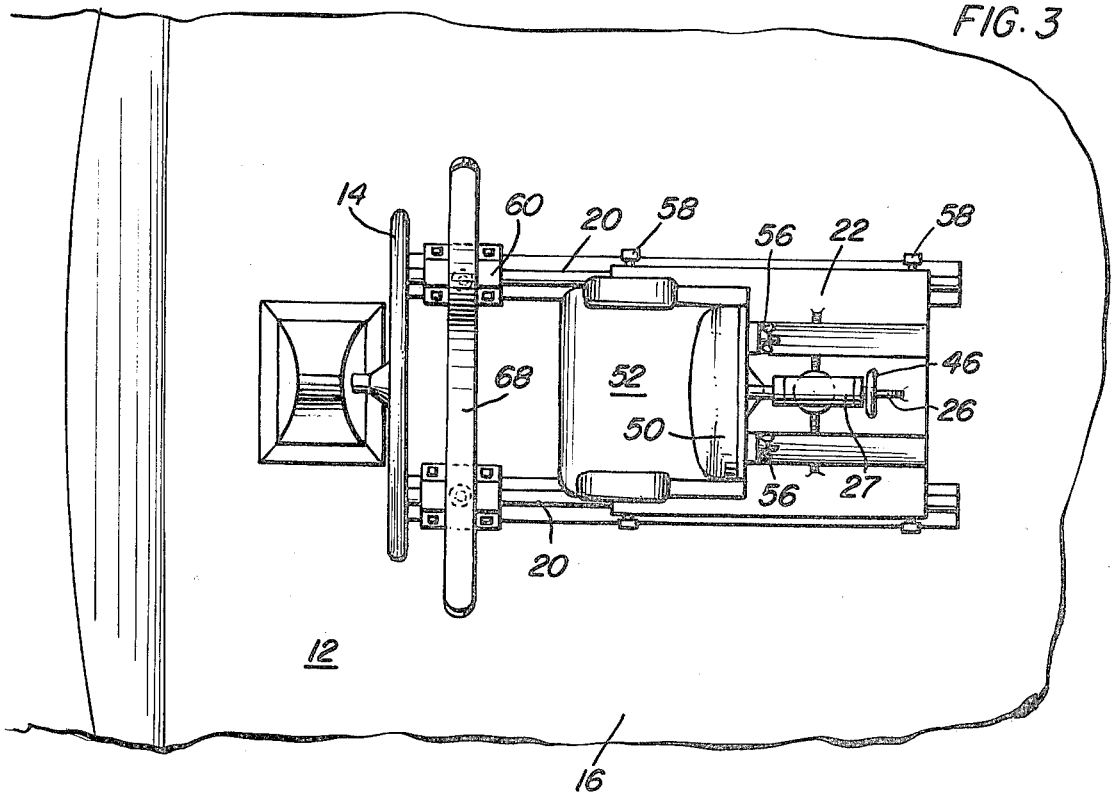
FIG. 3 is a top plan view of the assemblage illustrated in FIG. 1.
Figure 4:
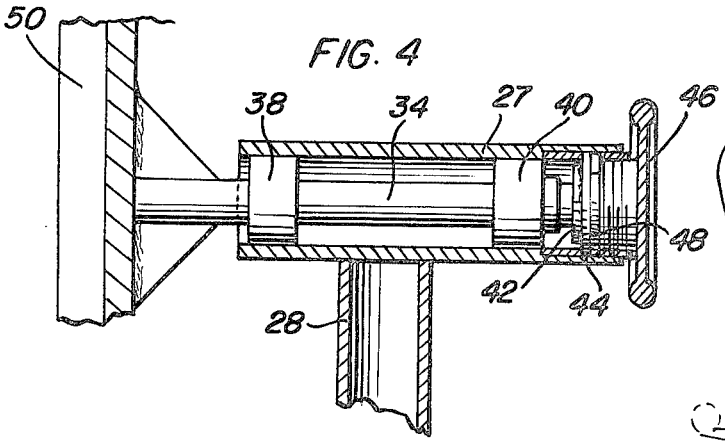
FIG. 4 is an enlarged, fragmentary, vertical sectional view taken substantially upon the plane indicated by the section line 4—4 of FIG. 1.

Referring now more specifically to the drawings, the numeral 10 generally designates a conventional form of sailboat including a cockpit area 12 in which a pedestal supported oscillatable wheel 14 is disposed. The wheel 14 comprises a conventional helm and is operatively connected to the rudder (not shown) of the sailboat 10 in any conventional manner.

The wheel or helm 14 is mounted for oscillation about a fore and aft extending horizontal axis and the axis of oscillation of the wheel 14 is spaced above the floor 16 of the cockpit area 12.

The helmsman's seat of the instant invention is referred to in general by the reference numeral 18 and includes a pair of parallel fore and aft extending tracks 20 anchored to the flooring 16 rearward of the wheel 14. The tracks 20 slidably support a base 22 therefrom for adjustable fore and aft positioning along the floor 16 and the base 22 includes an upright standard 24 which is tubular in construction and braced relative to the base 22 by gussets 26.

The helmsman's seat 18 further includes a mount portion 27 defining a fore and aft extending horizontal cylinder and a depending support rod 28 is carried by the cylinder 27 and is downwardly telescoped into the standard 24. The standard 24 includes vertically spaced radial bores 30 with which a bore 32 formed in the tubular rod 28 are registrable and a set screw 34 is engageable through the bore 32 and a corresponding bore 30 to retain the tubular rod 28 in adjusted position relative to the standard 24.

The mounting portion or cylinder 27 receives a support shaft 36 therethrough and the shaft 36 is journaled within the sleeve 27 through the utilization of suitable bearings 38 and 40. In addition, a pressure plate 42 is keyed to the shaft 36 within the rear end of the sleeve 27 and a clutch plate 42 is disposed within the sleeve 27 rearward of the pressure plate 22 and is keyed to the cylinder 27. A hand wheel 46 is threaded into the rear end of the cylinder 27 and includes a pressure plate 48 thereon frictionally engageable with the clutch plate 44. Accordingly, the pressure plates 42 and 48 and the clutch plate 44 function, in conjunction with the hand wheel 46, to provide an adjustable friction clutch for variably frictionally resisting rotation of the shaft 36 reltive to the sleeve 27.

The forward end of the shaft 36 supports a seat back 50 therefrom and the seat back 50 adjustably supports a seat portion 52 therefrom. The seat portion 52 includes opposite side upstanding support arms 54 vertically shiftable relative to the seat back 50 and releasably securable in adjusted position relative to the seat back 50 through the utilization of clamp screws 56. Accordingly, the entire assembly comprising the seat back 50 and seat cushion 62 may be vertically adjusted through the utilization of the set screw 34, or the seat cushion 52 may be vertically adjusted relative to the seat back 50 through the utilization of the clamp screw 56. In any event, the axis of oscillation of the shaft 36 is disposed in generally the same vertical plane as the axis of oscillation of the wheel 14. Further, the base 22 includes set screws 58 engageable with the tracks 20 in order to retain the base 22 in adjusted position along the tracks 20.

In addition to the seat assembly, the helmsman's seat 18 includes a footrest including a base portion 60 slidably mounted on the rails 20 and adjustably securable in position therealong through the utilization of set screws 62. The base portion 60 includes a pair of tubular uprights 64 and depending support rods 66 of an upwardly opening arcuate footrest 68 are downwardly telescoped into the upright 64 and secured in adjusted position therein through the utilization of suitable removable fasteners 70. The footrest 68 may be adjusted in elevation relative to the base portion 60 in order to substantially align the center of curvature of the footrest 68 with the axes of oscillation of the wheel 14 and the shaft 36.

Figure 6:
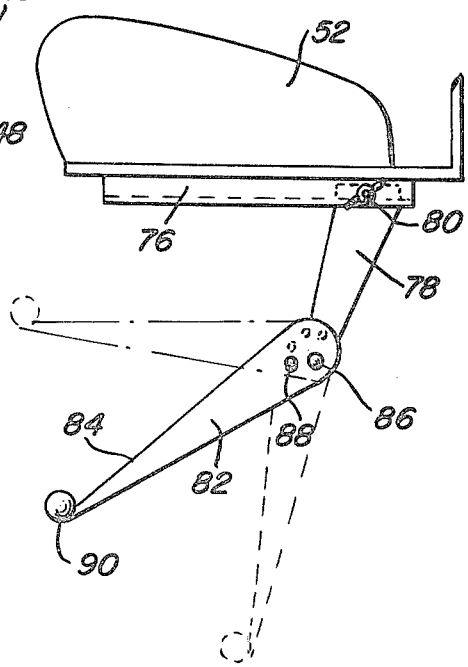
FIG. 6 is a fragmentary, side elevational view of a modified form of seat including an adjustable footrest supported directly therefrom.
Figure 5:
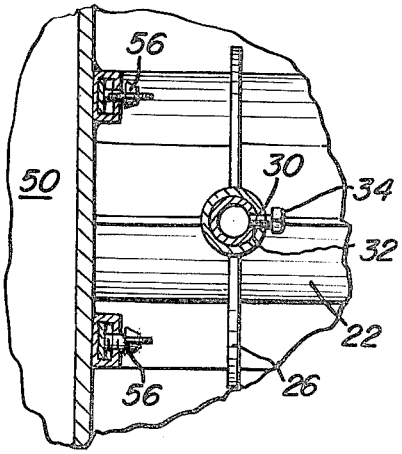
FIG. 5 is an enlarged, fragmentary, horizontal sectional view taken substantially upon the plane indicated by the section line 5—5 of FIG. 2.

However, if it is desired to utilize a footrest which is supported for pendulum swinging with the seat cushion 52, the underside of the seat cushion 52 may be equipped with front-to-rear extending opposite side guide rails 76 along which depending opposite side footrest support members 78 are shiftable. The adjusted shifted positions of the footrest support members 78 may be retained through the utilization of clamp screws 80 and the lower ends of the footrest support members 78 pivotally support the upper ends of the opposite side arms 82 of a U-shaped support rest 84 therefrom as at 86. In addition, set screws 88 are provided and are releasably securable through the upper ends of the arms 82 and the lower ends of the footrest support members 78 to adjustably secure the arms 82 in adjusted pivoted positions relative to the footrest support members 78. The bight portion 90 of the U-shaped rest 84 which extends between the free ends of the arms 82 may thus be adjustably positioned as indicated in FIG. 6 of the drawings. However, in most instances, the helmsman's seat 18 will be provided with the footrest 68.

Depending upon the size of the helmsman 94 seated in the helmsman's seat 18, the height of the seat comprising the seat back 50 and the seat cushion 52 may be adjusted at the set screw 34. In addition, the height of the seat cushion 52 relative to the seat back 50 may be adjusted at the clamp fastener 56. Further, the height of the footrest 68 may be adjusted relative to the seat structure.

Of course, the seat structure comprising the seat back 50 and seat cushion 52 is oscillatably supported in pendulum fashion from the cylinder 27 and frictional resistance to oscillation of the seat structure may be adjusted by the hand wheel 46.

Further, it is to be noted that the seat 18 could be mounted from the transom of the boat 10, or any other component thereof, adjacent the wheel 14. In such case, the base 18 could still be mounted on the support structure therefor by structure, not shown, affording fore and aft shifting of the seat 18 as well as vertical adjustment of the axis of oscillation thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a sailboat hull subject to roll movement including a rudder control member oscillatable about a first fore and aft extending horizontal axis, a helmsman's seat including mounting structure defining a base portion mounted in said hull and a mount portion supported from said base portion for adjustable vertical shifting relative thereto, a seat structure, support means oscillatably supporting said seat structure from said mount portion in pendulum fashion for swinging about a second fore and aft extending horizontal axis with said first and second axes disposed at least generally in the same vertical plane and said mount portion being vertically adjustable relative to said first axis to enable at least general alignment of said axes, said support means including adjustable friction brake means operative to adjustably vary frictional resistance to oscillation of said seat structure relative to said mount portion.

2. The combination of claim 1 including an upwardly opening arcuate footrest, mounting means stationarily mounting said footrest in said hull between said seat structure and said rudder control member at an elevation lower than said seat structure and with said footrest extending transversely of said hull and positioned for engagement by the feet of a helmsman seated in said seat structure, said mounting means including means operative to adjust the elevation of said footrest relative to said hull.

3. The combination of claim 1 including a forwardly and upwardly and rearwardly and downwardly swingable horizontal transverse footrest supported from said seat structure below the latter.

4. The combination of claim 1 wherein said base portion and hull include coacting means supporting said base portion from said hull for adjusted fore and aft shifting relative to said hull.

5. In combination with a sailboat hull subject to roll movement including a rudder control member oscillatable about a first fore and aft extending horizontal axis, a helmsman's seat including mounting structure defining a base portion mounted in said hull and a mount portion supported from said base portion, a seat support means oscillatably supporting said seat structure from said mount portion in pendulum fashion for swinging about a second fore and aft extending horizontal axis with said first and second axes disposed in at least general alignment, said support means including adjustable friction brake means operative to adjustably vary frictional resistance to oscillation of said seat structure relative to said mount portion.

* * * * *